US007470128B2

(12) United States Patent
Ju

(10) Patent No.: US 7,470,128 B2
(45) Date of Patent: Dec. 30, 2008

(54) ELECTRICAL CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/976,773

(22) Filed: Oct. 29, 2007

(65) Prior Publication Data

US 2008/0153338 A1 Jun. 26, 2008

(30) Foreign Application Priority Data

Dec. 21, 2006 (CN) ..... 2006 2 0155060 U

(51) Int. Cl.
*H01R 13/62* (2006.01)

(52) U.S. Cl. ..... 439/73; 439/331

(58) Field of Classification Search ..... 439/73, 439/331

See application file for complete search history.

(56) References Cited

U.S. PATENT DOCUMENTS 3,014,437 A * 12/1961 Dutchess ..... 366/76.6
5,724,728 A * 3/1998 Bond et al. ..... 29/840
5,735,698 A * 4/1998 Bakker et al. ..... 439/91
6,022,225 A * 2/2000 Chapin et al. ..... 439/73
6,716,049 B1 * 4/2004 Gattuso et al. ..... 439/331
6,991,474 B1 * 1/2006 Ju ..... 439/73
7,147,483 B1 * 12/2006 Ju ..... 439/73
2004/0097119 A1 * 5/2004 Ma ..... 439/331
2008/0009152 A1 * 1/2008 Colbert et al. ..... 439/73

FOREIGN PATENT DOCUMENTS

CN 03272386.5 10/2004
CN 200520063327.X 9/2006

* cited by examiner

*Primary Examiner*—Gary F. Paumen
(74) *Attorney, Agent, or Firm*—Rosenberg, Klein & Lee

(57) ABSTRACT

An electrical connector is used for connecting a chip module to a circuit board, and includes an insulating body, conducting pins, a rod, and a fastening device. The rod includes a pressing rod, and fastening portions. The pressing rod has a pressing portion for pressing the chip module. The fastening portions are located at two ends of the rod. The fastening device includes a back plate, and a fastening hook that is located on the back plate. The fastening portion of the rod is wedged to the fastening hook of the fastening device. Thereby, the chip module is firmly fastening in the insulating body. The assembling process is easy. Furthermore, because both ends of the rod have the fastening portions, the electrical connector can achieve the same effect, without the enhancing flake, the pressing board and the moving part. Its structure is simple, and the manufacturing cost is low.

10 Claims, 5 Drawing Sheets

ELECTRICAL CONNECTOR

BACKGROUND OF THE INVENTION

1. Field of the Invention

The present invention relates to an electrical connector. In particular, this invention relates to an electrical connector that connects the chip module to a circuit board.

2. Description of the Related Art

CPU is the most important component for the computers. The operation speed and the quality of the computer are also determined by the CPU. As the performance and quality of the CPU are enhanced, how to develop an electrical connector to firmly fasten the CPU onto the circuit board becomes a concerned topic.

The electrical connector for fastening the CPU onto the circuit board, such as disclosed in China patent CN03272386.5, includes a main body, an enhancing flake located at outside of the main body, a pressing board for pressing the chip module, and a moving part that cooperates with the pressing board to press the chip module. However, the structure of the electrical connector is complex, the manufacturing cost is high, and the welding effect is affected due to a lot of components are required for the electrical connector. In order to overcome the drawbacks, an electrical connector, such as China patent CN200520063327.X, is disclosed. The electrical connector uses rods to fasten the chip module onto the electrical board. The electrical connector has two rods. On the insulting body, there is a pivoting part to rotatbly connect the two rods to the insulating body. By rotating the two rods orderly, the two rods are pressed on the chip module. However, the two rods are separated so that the two rods must be rotated orderly to press the chip module. It is inconvenient for the user to assembling the chip module and it takes a long time to assemble it. The structure of the electrical connector is also complex due to there is a pivoting part on the insulating body of the electrical connector.

SUMMARY OF THE INVENTION

One particular aspect of the present invention is to provide an electrical connector. Its structure is simple, it is easy to assemble it, and the manufacturing cost is low.

The electrical connector is used for connecting a chip module to a circuit board. The electrical connector includes an insulating body, conducting pins, a rod for fastening the chip module on the insulating body, and a fastening device that cooperates with the rod. The rod includes a pressing rod, and fastening portions. The pressing rod has a pressing portion for pressing the chip module. The fastening portions are located at two ends of the rod. The fastening device includes a back plate, and a fastening hook that is located on the back plate and protrudes to outside of the back plate. The fastening portion of the rod is wedged to the fastening hook of the fastening device.

When the chip module is assembled, the chip module is located on the insulating body. Next, the fastening portions located at the two ends of the rod are wedged to the fastening hook of the back plate to fasten the chip module in the insulating body. The assembling process is easy. Furthermore, because both ends of the rod have the fastening portions, it is convenient to assemble it. The electrical connector can achieve the same effect, without the enhancing flake, the pressing board and the moving part. Its structure is simple, and the manufacturing cost is low.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
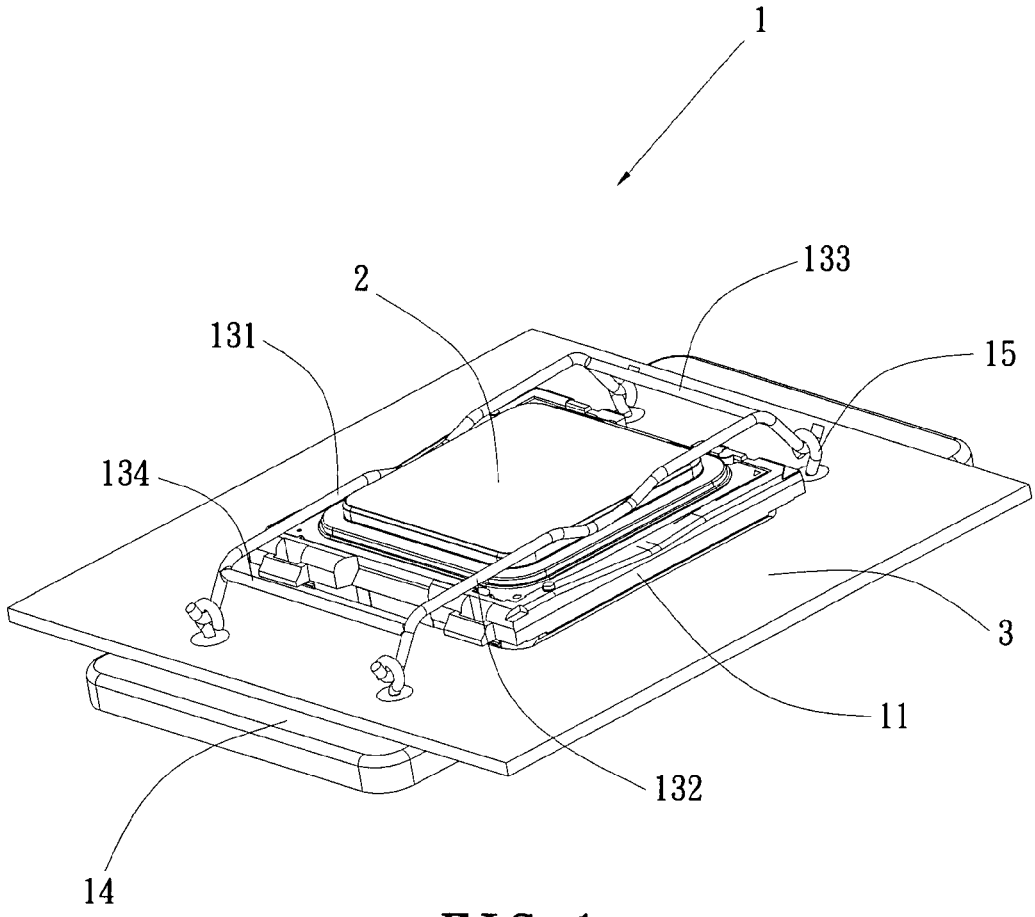
FIG. 1 is an assembly perspective view of the electrical connector, the chip module and the circuit board of the present invention.
Figure 2:
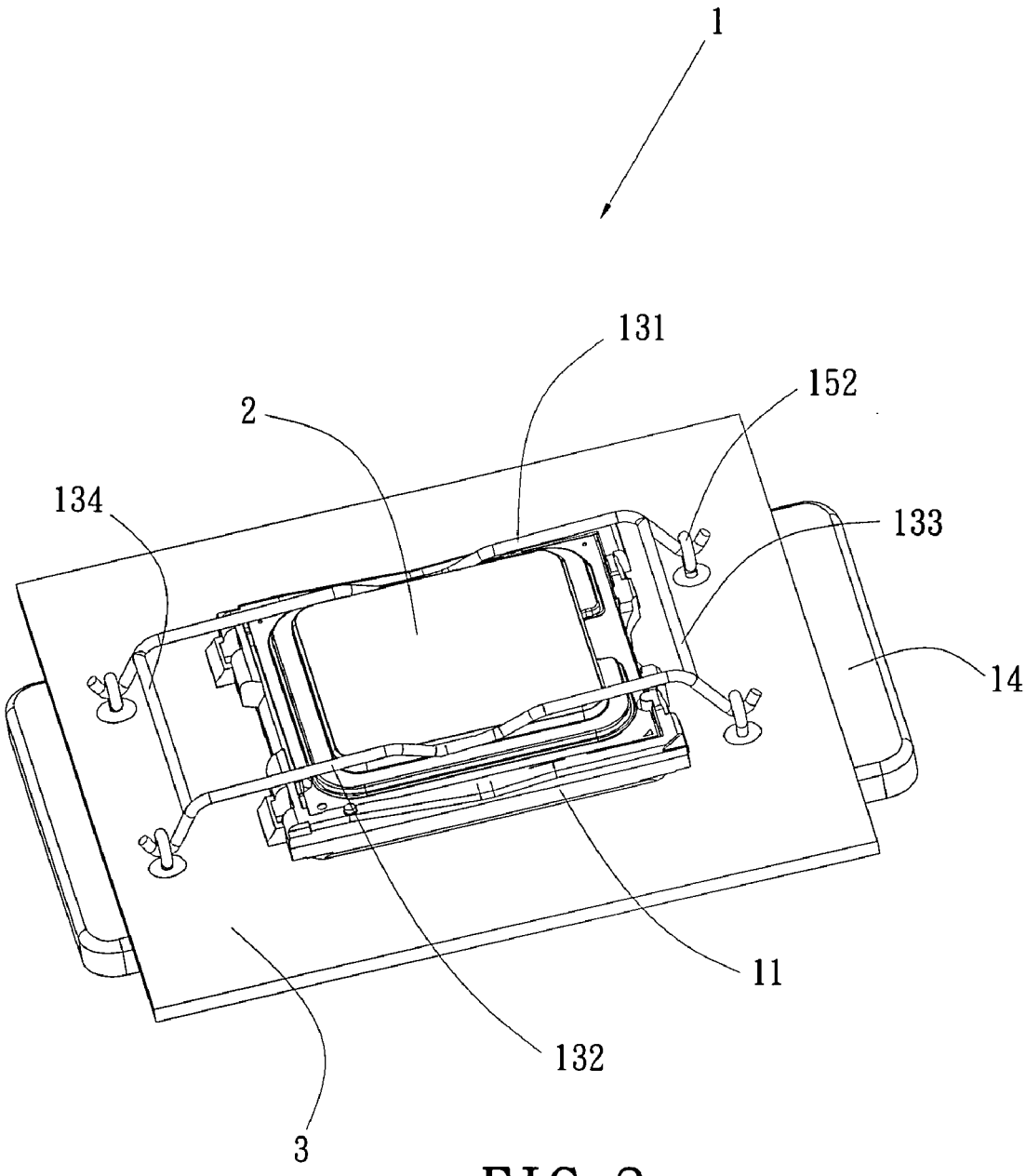
FIG. 2 is another assembly perspective view of the electrical connector, the chip module and the circuit board of the present invention.
Figure 3:
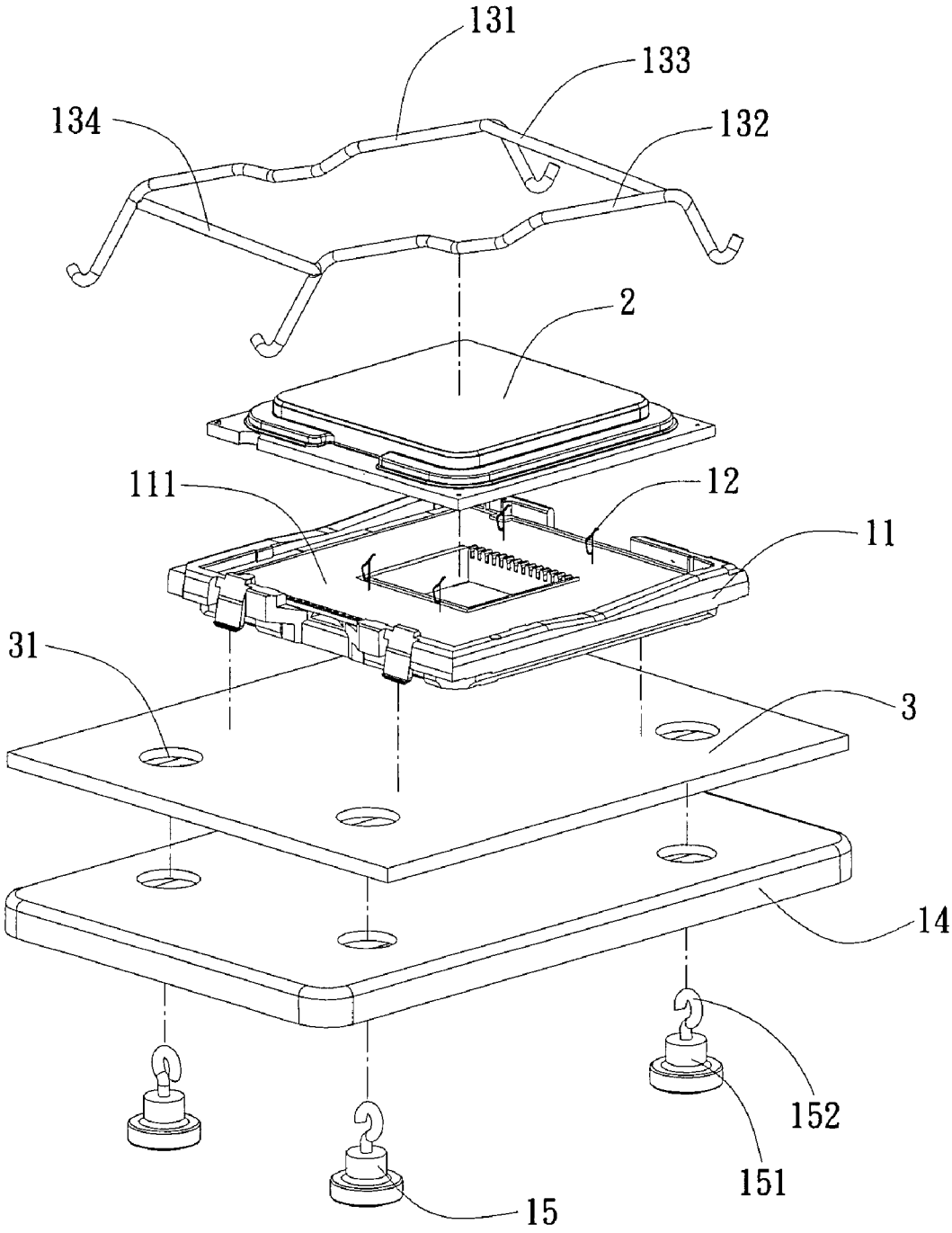
FIG. 3 is an exploded perspective view of the electrical connector, the chip module and the circuit board of the present invention.
Figure 4:
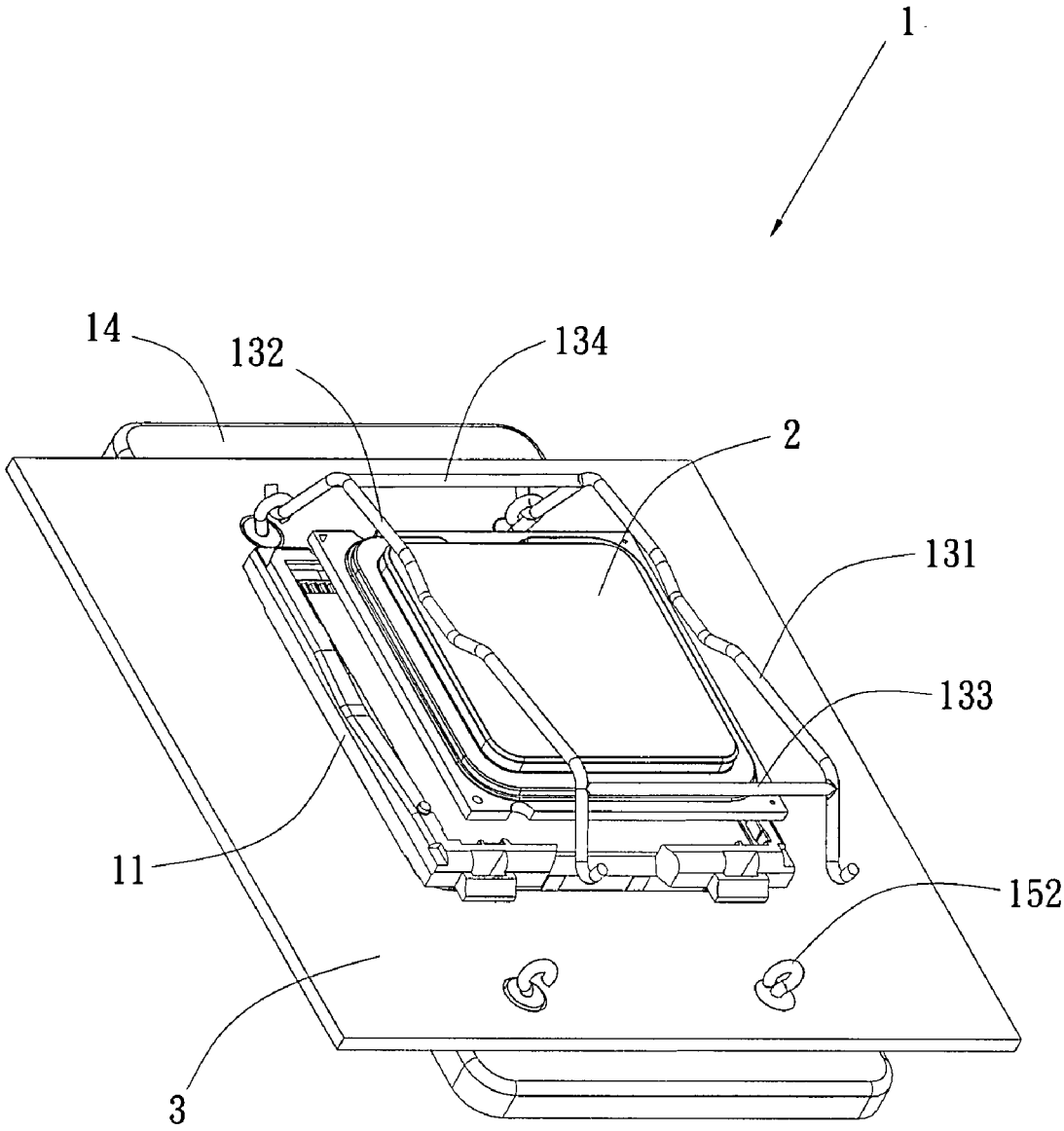
FIG. 4 is a schematic diagram of the electrical connector of the present invention being in a semi-closed status.
Figure 5:
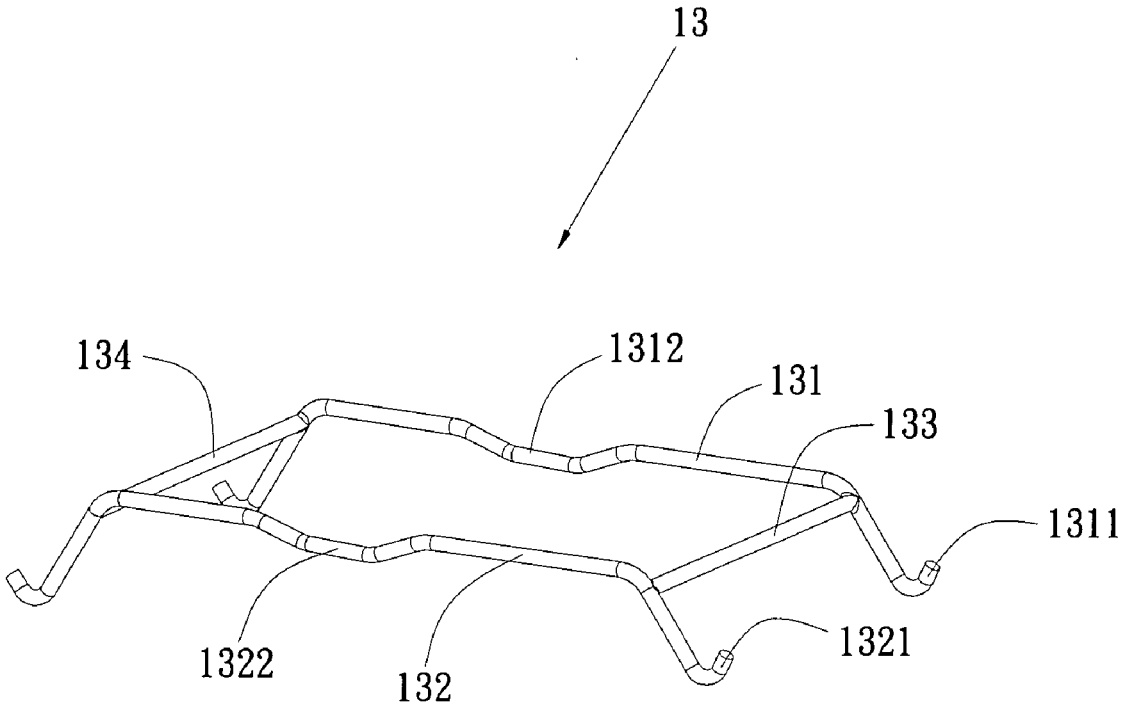
FIG. 5 is a perspective view of the rod of the electrical connector of the present invention.

Reference is made to FIGS. 1~5. The electrical connector 1 includes an insulating body 11, a plurality of conducting pins 12 located in the insulating body 11 (part of the conducting pins are shown in the figure), and a rod 13 for fastening a chip module 2 on the insulating body 11. The rod 13 includes a first pressing rod 131, a second pressing rod 132, and a fastening device that cooperates with the first pressing rod 131 and the second pressing rod 132. The fastening device includes a back plate 14, and a fastening hook 15 that is located on the back plate 14 and protrudes to outside of the back plate 14.

The insulating body 11 is fastened onto the circuit board 3. At the middle of the insulating body 11, a concave portion 111 is formed for receiving the chip module 2.

The conducting pins 12 are located in the insulating body 11 for electrically connecting the chip module 2 to the circuit board 3.

The fastening hook 15 is located on the back plate 14, and the fastening hook 15 and the back plate 14 are independent each other. The fastening hook 15 is received and fastened in the back plate 14. The fastening hook 15 includes a fixing portion 151 fastened on the back plate 14, and a hook portion 152 that is integrated with the fixing portion 151 into one piece. The hook portion 152 can pass through a through hole 31 on the circuit board 3 and cooperate with the rod 13. Alternatively, the fastening hook 15 can be integrated with the back plate 14 into one piece and protrudes to outside of the back plate 14.

The first pressing rod 131 and the second pressing rod 132 are symmetrical. The first pressing rod 131 and the second pressing rod 132 includes fastening portions 1311, 1321, pressing portions 1312, 1322, a first linking rod 133 connected with the first pressing rod 131, and a second linking rod 134 connected with the second pressing rod 132 (In this embodiment, there are two linking rods. Alternatively, there are over than two linking rods between the first pressing rod 131 and the second pressing rod 132.) The fastening portions 1311, 1321 slantedly extends downwards from two ends of the first pressing rod 131 and the second pressing rod 132 and then bends upwards. The fastening portions 1311, 1321 fit in with the hook portion 152 of the fastening hook 15 on the back plate 14. The pressing portions 1312, 1322 protrudes downwards from the middle of the first pressing rod 131 and the second pressing rod 132. After the electrical connector is assembled, the pressing portions 1312, 1322 leans against the chip module 2 to fasten the chip module 2 on the insulating body 11 of the electrical connector 1. The pressing portions 1312, 1322 are flat-shaped so that the chip module 2 is firmly fastened on the insulating body 11. The first linking rod 133 and the second linking rod 134 are located between the first pressing rod 131 and the second pressing rod 132 so that the pressing portions 1312, 1322 of the first pressing rod 131 and the second pressing rod 132 can uniformly exert a force on the chip module 2 and the first pressing rod 131 and the second pressing rod 132 firmly fasten the chip module 2. The first linking rod 133 and the second linking rod 134 also have pressing portions for leaning against the chip module 2.

When the electrical connector is assembled, the insulating body 11 of the electrical connector 1 is fastened onto the circuit board 3. The fastening hook 15 is installed on the back plate 14. Next, the hook portion 152 of the fastening hook 15 on the back plate 14 aligns to the through hole 31 of the circuit board 3. Continuously, the chip module 2 is placed in the concave portion 111 located at the middle of the insulating body 11 of the electrical connector 1. An external force is exerted on the fastening portions 1311, 1321 located at one end of the first pressing rod 131 and the second pressing rod 132 to wedge with the hooking portions 152 of the fastening hook 15. Finally, the fastening portions 1311, 1321 located at another end of the first pressing rod 131 and the second pressing rod 132 wedges with the hooking portions 152 of the fastening hook 15 located at another side of the back plate 14. Thereby, the chip module 2 is assembled with the electrical connector 1

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. An electrical connector, used for connecting a chip module to a circuit board, comprising:

an insulating body;

a plurality of conducting pins located in the insulating body;

a rod for fastening the chip module on the insulating body; and a fastening device that cooperates with the rod;

wherein the rod comprises a pressing rod, and fastening portions, the pressing rod has a pressing portion for pressing the chip module, the fastening portions are located at two ends of the rod, the fastening device comprises a back plate, and a fastening hook that is located on the back plate and protrudes to outside of the back plate, and the fastening portion of the rod is wedged to the fastening hook of the fastening device.

2. The electrical connector as claimed in claim 1, wherein the fastening portions slantedly extends downwards from two ends of the rod and then bends upwards.

3. The electrical connector as claimed in claim 1, wherein the fastening hook and the back plate are independent each other, and the fastening hook is received and fastened in the back plate.

4. The electrical connector as claimed in claim 1, wherein the fastening hook comprises a fixing portion fastened on the back plate, and a hook portion that is integrated with the fixing portion into one piece.

5. The electrical connector as claimed in claim 1, wherein the fastening hook is integrated with the back plate into one piece.

6. The electrical connector as claimed in claim 1, wherein the rod has a pressing portion for leaning against the chip module.

7. The electrical connector as claimed in claim 1, wherein the rod comprises a first pressing rod and a second pressing rod, and there is a linking rod between the first pressing rod and the second pressing rod.

8. The electrical connector as claimed in claim 7, wherein the first pressing rod and the second pressing rod have a pressing portion for leaning against the chip module.

9. The electrical connector as claimed in claim 7, wherein the linking rod has a pressing portion that protrudes from the linking rod and is used for leaning against the chip module.

10. The electrical connector as claimed in claim 7, wherein the first pressing rod and the second pressing rod are disposed symmetrically.

* * * * *